US012663228B2

(12) United States Patent
Kielsmeier et al.

(10) Patent No.: US 12,663,228 B2
(45) **Date of Patent: *Jun. 23, 2026**

(54) AMMUNITION MAGAZINE WITH ASYMMETRIC FEEDING

(71) Applicant: Magpul Industries Corp., Austin, TX (US)

(72) Inventors: Nicholas Kielsmeier, Denver, CO (US); Libardo Jimenez, Arvada, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/826,493

(22) Filed: Sep. 6, 2024

(65) Prior Publication Data

US 2024/0426565 A1 Dec. 26, 2024

Related U.S. Application Data

(63) Continuation of application No. 17/766,963, filed as application No. PCT/US2020/056243 on Oct. 19, 2020, now Pat. No. 12,130,110.

(60) Provisional application No. 62/916,910, filed on Oct. 18, 2019.

(51) Int. Cl.
*F41A 9/70* (2006.01)

(52) U.S. Cl.
CPC ..... *F41A 9/70* (2013.01)

(58) Field of Classification Search
CPC .... F41A 9/70; F41A 9/69; F41A 11/02; F41A 9/65; F41A 9/71; F41A 11/00
USPC ..... 42/50, 49.01, 49.02, 87; 89/29
See application file for complete search history.

(56) References Cited

U.S. PATENT DOCUMENTS

| | | | |
|---|---|---|---|
| 5,417,003 | A | 5/1995 | Claveau |
| 7,121,035 | B2 | 10/2006 | Greer |
| 7,444,775 | B1 | 11/2008 | Schuetz |
| 8,356,439 | B2 | 1/2013 | Dubois |
| 8,813,406 | B1 | 8/2014 | Sullivan et al. |
| 9,121,314 | B2 | 9/2015 | Yacoub |

(Continued)

FOREIGN PATENT DOCUMENTS

RU 2683921 C1 4/2019

OTHER PUBLICATIONS

.223 MDT Polymer AICS Magazine, MDT, 2 pages, online available at, retrieved on: Jun. 22, 2023.

(Continued)

*Primary Examiner* — Michael D David
(74) *Attorney, Agent, or Firm* — NOD Law PC

(57) ABSTRACT

This disclosure describes systems, methods, and apparatus for a magazine assembly for a firearm, the magazine assembly comprising: an elongated housing, a spring positioned in an interior of the housing, a first and second plate at a proximal end of the housing, at least one follower configured to support one or more cartridges and move or slide within the housing based on a compression and decompression of the spring, one or more feed lips positioned at a distal end of the housing, the one or more feed lips adapted to prevent upward movement of a topmost of the one or more cartridges until a bolt or slide chambers the topmost of the one or more cartridges, and wherein the topmost cartridge is arranged off-center from the bolt of the firearm so as to increase an engagement or overlap between the bolt and the topmost cartridge.

19 Claims, 15 Drawing Sheets

(56) References Cited

U.S. PATENT DOCUMENTS

| | | | | |
|---|---|---|---|---|
| 9,222,739 | B1 | 12/2015 | Bennett et al. | |
| 9,372,040 | B2 | 6/2016 | Zheng | |
| 9,404,694 | B2 | 8/2016 | Hochstrate et al. | |
| 9,714,804 | B2 | 7/2017 | Singh | |
| 9,976,825 | B2 | 5/2018 | Faifer | |
| 10,222,153 | B1 * | 3/2019 | Harding | F41A 9/71 |
| 10,228,202 | B2 | 3/2019 | Jarboe | |
| 10,415,910 | B1 | 9/2019 | Zukowski | |
| 10,429,144 | B2 | 10/2019 | Cudazzo | |
| 10,605,553 | B1 | 3/2020 | Collazo et al. | |
| 11,859,936 | B2 * | 1/2024 | Philbin | F41A 17/38 |
| 12,130,110 | B2 | 10/2024 | Kielsmeier et al. | |
| 2005/0115128 | A1 | 6/2005 | Hahin | |
| 2013/0167420 | A1 | 7/2013 | Zheng | |
| 2014/0007480 | A1 | 1/2014 | Pulit, Jr. | |
| 2014/0075810 | A1 | 3/2014 | Mikroulis et al. | |
| 2015/0192377 | A1 * | 7/2015 | Larson, Jr. | F41A 9/65 42/50 |
| 2015/0192384 | A1 | 7/2015 | Ballard | |
| 2015/0292826 | A1 | 10/2015 | Kielsmeier et al. | |
| 2015/0345882 | A1 | 12/2015 | Nakayama et al. | |
| 2018/0023909 | A1 * | 1/2018 | Ladner | F41A 9/70 42/49.02 |
| 2018/0023912 | A1 | 1/2018 | Cudazzo | |
| 2021/0215446 | A1 | 7/2021 | Czarnecki et al. | |
| 2022/0252365 | A1 | 8/2022 | Philbin et al. | |
| 2024/0077266 | A1 | 3/2024 | Kielsmeier et al. | |
| 2024/0288239 | A1 * | 8/2024 | Masarik | F41A 19/01 |

OTHER PUBLICATIONS

AI 10 Round Magazine .308, Short Action Precision, Precision Rifle Optics & Accessories, 1 page, on line available at , retrieved on: Jun. 22, 2023.

Examination Report under section 18(3) received for GB Patent Application Serial No. GB2116402.5 dated Mar. 21, J023, 2 pages.

International Preliminary Report on Patentability Chapter I received for PCT Application Serial No. PCT/US2020/056243 dated Apr. 19, 2022, 8 pages.

International Search Report for PCT Application Serial No. PCT/US2020/056243 dated Jul. 1, 2021, 2 pages.

Written Opinion of the International Searching Authority for PCT Application Serial No. PCT/US2020/056243 dated Jul. 1, 2021, 7 pages.

UKIPO, Search report received for Application No. GB2313249.1, Oct. 26, 2023, 4 pages.

* cited by examiner

AMMUNITION MAGAZINE WITH ASYMMETRIC FEEDING

CLAIM OF PRIORITY UNDER 35 U.S.C. § 119

The present Application for Patent is a Continuation Application of U.S. patent application Ser. No. 17/766,963 entitled "AMMUNITION MAGAZINE WITH ASYMMETRIC FEEDING" filed Apr. 6, 2022, which is the United States National Phase of International Patent Application No. PCT/US2020/056243 entitled "AMMUNITION MAGAZINE WITH ASYMMETRIC FEEDING" filed Oct. 19, 2020, which claims priority to and the benefit of U.S. Provisional Application No. 62/916,910 entitled "AMMUNITION MAGAZINE WITH ASYMMETRIC FEEDING" filed Oct. 18, 2019, and assigned to the assignee hereof, said applications are hereby expressly incorporated by reference herein.

FIELD OF THE DISCLOSURE

The present invention relates to firearms. In particular, but not by way of limitation, the present invention relates to systems and methods for firearm magazines.

DESCRIPTION OF RELATED ART

Bolt action firearms are typically fabricated with a specific cartridge size in mind (e.g., 7.62 mm round, 5.56 mm, 0.22 LR, 0.223 Remington, 0.300 BLK, to name a few non-limiting and common examples). However, manufacturers have started looking to more modular designs where a common stock, receiver, and bottom metal can be combined with barrels and magazines for different cartridge sizes. However, since the bottom metal remains the same across these different modular designs, smaller magazines, e.g., for 5.56 mm, are modified or bulked up to fit the wider bottom metal originally-sized for larger cartridges, such as 7.62 mm or .308. While the outer dimension of these adapted magazines increases, the cartridges themselves have a smaller diameter and thus see less overlap, or show less surface area, for the bolt to interact with. This leads to increased chances of malfunctions, for instance, because of insufficient overlap of the bolt face and the topmost round in the magazine. In some cases, a round can get caught between feed ramps, the chamber, and the bolt, after extraction and ejection of the previous round.

Thus, there is a need for a magazine assembly that addresses some of the shortfalls of the present technology where smaller diameter rounds are being used in firearms originally configured for larger diameter rounds.

SUMMARY OF THE DISCLOSURE

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

In some instances, a user may wish to keep an original configuration of their firearm with minimal changes to the bolt and/or the standard bottom metal, while still having the ability to fire cartridges of both a smaller and a larger diameter. In some cases, the firearm may originally be configured for use with said larger diameter cartridges. Broadly, aspects of the present disclosure relate to an ammunition magazine configured to store and feed cartridges of a smaller caliber into a firearm configured for larger caliber cartridges.

In some cases, the use of smaller cartridges in a firearm, such as a bolt-action rifle, originally configured for larger diameter cartridges may lead to bolt over stoppages, overall length sensitivities, and follower dive, which may adversely impact user experience. To overcome these deficiencies and enhance user experience, aspects of the present disclosure relate to an ammunition magazine with asymmetric feeding, which may serve to maximize bolt face engagement, resist follower dive, and optimize feeding, thus alleviating bolt face overlap issues. In some cases, the asymmetric feeding may be achieved via the use of an offset feedlip geometry, an asymmetric magazine body, or a combination. In some embodiments, the magazine described in this disclosure may be configured for use with short or long action rifles. In some cases, the magazine may be designed and configured for short action rifles comprising Accuracy International Chassis Systems (AICS) pattern bottom metal, and cartridges built on a 0.378 inch case head (e.g., 0.223 Remington) and an overall cartridge length of up to 2.39 inches, although different case head and cartridge length dimensions are contemplated in different embodiments.

Some embodiments of the disclosure may be characterized as a magazine assembly for a firearm, the magazine assembly comprising: an elongated housing comprising a proximal end and a distal end; a spring positioned in an interior of the housing; a first plate removably engaged with the proximal end of the housing; a second plate configured to engage with the first plate and secure the first plate at the proximal end of the housing; at least one follower configured to move or slide within the housing based in part on a compression and decompression of the spring, and wherein the at least one follower is configured to support one or more cartridges; one or more feed lips positioned at the distal end of the housing, wherein the one or more feed lips are adapted to prevent upward movement of a topmost of the one or more cartridges until a bolt or slide chambers the topmost of the one or more cartridges; and wherein the topmost cartridge is arranged off-center from the bolt of the firearm so as to increase an engagement or overlap between the bolt and the topmost cartridge. In some cases, the topmost cartridge may be in a single stack configuration, although different cartridge configurations at the top of the magazine are contemplated in other embodiments.

Other embodiments of the disclosure may also be characterized as a firearm having a magazine well, said firearm comprising: a stock assembly comprising at least an action assembly, the action assembly comprising: one of a bolt or a slide movable between an open and a closed position, a trigger assembly, and a receiver, wherein the receiver is configured for use with cartridges of a first size; a forend assembly comprising at least a barrel, the barrel having a muzzle at its firing end; and a magazine releasably inserted into the magazine well of said firearm and held in place by a magazine latch or release, wherein the magazine is configured to store and feed cartridges of a second size into the firearm, the second size different from the first size. In some embodiments, the magazine may comprise an elongated housing having a distal end and a proximal end, a first plate removably engaged with the proximal end of the housing, a spring, a follower, the follower configured to move or slide within the elongated housing based in part on a compression and decompression of the spring, feed lips positioned at the distal end of the housing, wherein the feed lips are adapted to hold a topmost cartridge of the plurality of cartridges within the magazine until the topmost cartridge is fed into a chamber of the firearm upon action of the bolt or slide of the firearm; and wherein one or more of the elongated housing and feedlips are shaped and positioned to force the topmost cartridge to be off-center from the bolt of the firearm so as to increase an engagement or overlap between the bolt and the topmost cartridge. In some cases, the topmost cartridge may be in a single stack configuration, although different cartridge configurations at the top of the magazine are contemplated in other embodiments.

Other embodiments of the disclosure can be characterized as a method for manufacturing a firearm magazine, the firearm magazine configured to store and feed cartridges of a first size into a firearm originally configured to fire cartridges of a second larger size, said firearm comprising: one of a bolt or a slide movable between an open and a closed position, the method comprising: forming an asymmetrical elongated housing with a proximal end, a distal end, at least one sidewall, and at least one tapered section between the proximal and distal end; affixing a first plate at the proximal end; positioning a follower in the housing; positioning a spring between the follower and the first plate, wherein the spring is configured to move or slide the follower within the housing based on a compression or decompression of the spring; and forming feedlips at the distal end of the elongated housing, wherein the feed lips are adapted to hold a topmost cartridge of a plurality of cartridges within the firearm magazine until the topmost cartridge is fed into a chamber of the firearm upon action of the bolt or the slide of the firearm, and wherein one or more of the feedlips, the elongated housing, and the tapered section are shaped to force the topmost cartridge to be off-center from the bolt of the firearm so as to increase an engagement or overlap between the bolt and the topmost cartridge prior to feeding. In some cases, the topmost cartridge may be in a single stack configuration, although different cartridge configurations at the top of the magazine are contemplated in other embodiments.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of 'a', 'an', and 'the' include plural referents unless the context clearly dictates otherwise.

BRIEF DESCRIPTION OF THE DRAWINGS

Various advantages and a more complete understanding of the present invention are apparent and more readily appreciated by reference to the following Detailed Description and to the appended claims when taken in conjunction with the accompanying Drawings wherein:

DETAILED DESCRIPTION

The word "exemplary" is used herein to mean "serving as an example, instance, or illustration." Any embodiment described herein as "exemplary" is not necessarily to be construed as preferred or advantageous over other embodiments. In the following detailed description, references are made to the accompanying drawings that form a part hereof, and in which are shown by way of illustrations or specific examples. These aspects may be combined, other aspects may be utilized, and structural changes may be made without departing from the present disclosure. Example aspects may be practiced as methods, systems, or apparatuses. The following detailed description is therefore not to be taken in a limiting sense, and the scope of the present disclosure is defined by the appended claims and their equivalents.

For the purposes of this disclosure, and when referencing the magazine, the terms "top end", upper end", and "distal" shall refer to a side or direction closer to the firearm; while the term "lower end", "bottom end", and "proximal" shall refer to a side or direction away from the firearm. Further, when referencing a direction of intended fire, the terms "front" and "distal" shall refer to a side or direction associated with a direction of intended fire (e.g., in FIG. 1, the front or distal side is towards the top of the page), while the terms "back", "rear", or "proximal" shall be associated with the intended bracing of the firearm (e.g., in FIG. 1, the proximal side is towards the bottom of the page).

As previously indicated, it may be desirable for a user of a firearm to use cartridges of a smaller diameter in a firearm built to handle larger cartridges. However, misfeeding (e.g., a bolt over base malfunction) is a common problem encountered while using existing platforms. This disclosure alleviates these problems by providing a magazine assembly that is configured to increase the engagement, or overlap, between the bolt and the topmost cartridge of the magazine by forcing the topmost cartridge to be slightly off-center (e.g., in a horizontal direction or left-right direction; e.g., out of a plane that runs vertically through a longitudinal axis of the bolt and barrel) from the bolt via the use of an asymmetric body, asymmetric feed lips, or a combination.

Thus, broadly, the present disclosure may be directed towards a magazine assembly configured to store and feed rounds of a first size into a firearm originally configured to fire rounds of a second larger size. For instance, in one example, the present invention may relate to a polymer based magazine capable of storing and feeding 5.56 NATO/0.223 REMINGTON/0.300 BLK cartridges, and configured to fit the MAGPUL PRO 700 chassis designed by MAGPUL Inc., another applicable Aluminum (Al) chassis, the MAGPUL HUNTER 700, also designed by MAGPUL Inc., other compatible REMINGTON 700 actions with appropriate bottom metal, and the MAGPUL HUNTER AMERICAN stock.

Figure 1:
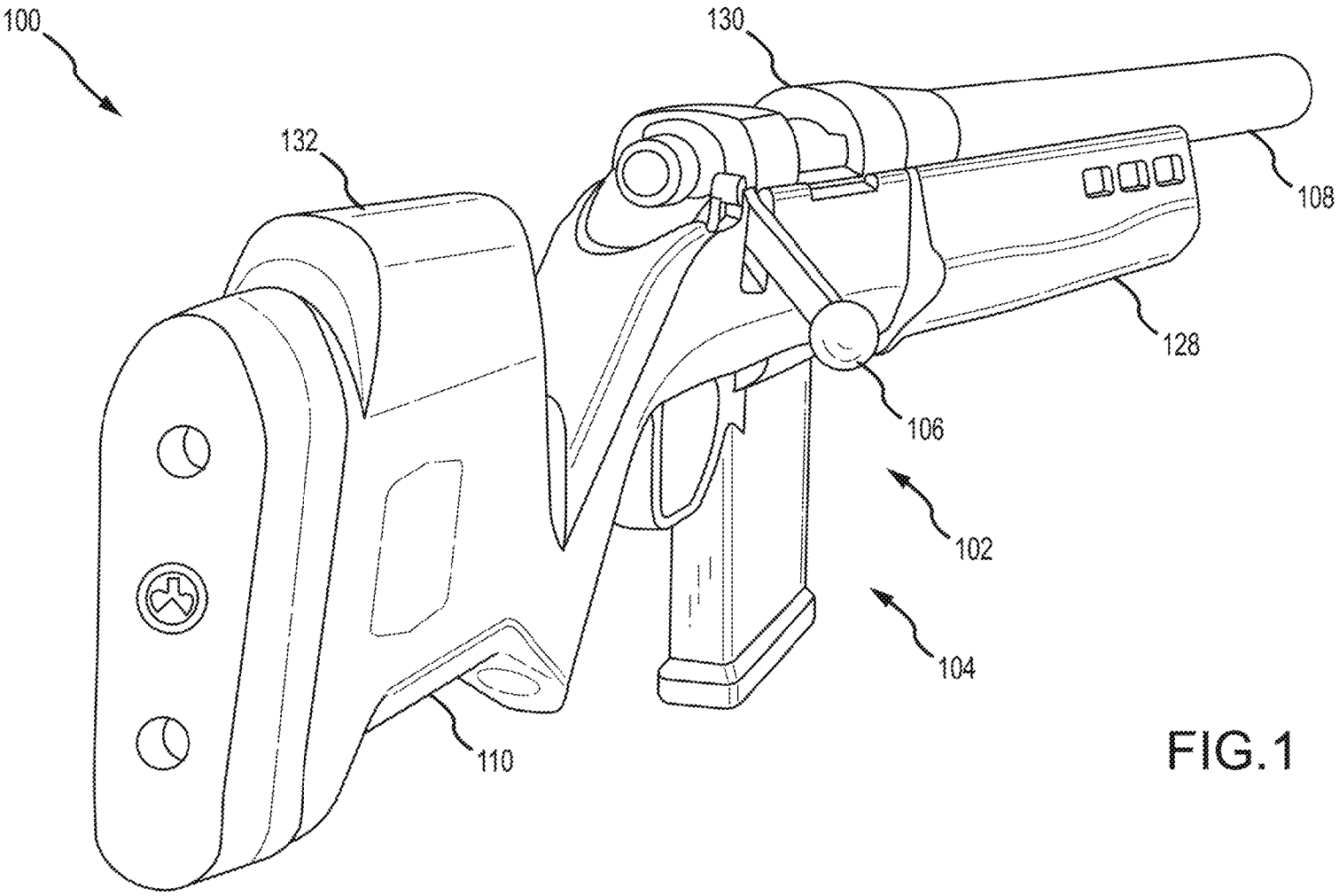
FIG. 1 is a side perspective view of a firearm and stock assembly, illustrating the magazine assembly and bolt, in accordance with one or more implementations.

FIG. 1 illustrates a firearm 100 configured to use an exemplary magazine. In some cases, FIG. 1 may implement one or more aspects of the figures described herein. The firearm 100 may include a stock assembly 110, a forend assembly 128, and a magazine-bolt group 102. In some cases, the stock assembly 102 can include the action assembly, a buttstock, a cheek piece 132, and one or more other components. In some cases, the magazine-bolt group 102 may comprise a bolt 106 and a magazine 104 releasably inserted into an action assembly of the stock assembly 110. In some cases, the magazine 104 may attach to the firearm 100 using a magazine latch or magazine release (hereinafter referred to as a "latch"), or any other means for attaching to/being released from a desired firearm, such as firearm 100. In some cases, the latch may be released using a lever or a magazine release to facilitate removal of the magazine 104 from the firearm 100.

In some cases, the action assembly may be removable from the stock assembly 102, and can include a trigger assembly, receiver 130, and the bolt 106 among other components. The action assembly may be configured for use with any caliber of round, such as 7.62 mm or 5.56 mm. In some cases, the forend assembly 128 can include a barrel 108, the barrel 108 having a muzzle at its firing end. Although a bolt-action firearm is illustrated in FIG. 1 and throughout this disclosure, the novel structures disclosed herein are also applicable to semi-automatic firearms such as AR and AK platforms, to name just two non-limiting examples.

Referring now to FIGS. 2 through 9, and 11, the magazine-bolt group 102 may comprise the magazine 104 and the bolt 106. In some cases, and as described with reference to FIGS. 5 and 6, the magazine 104 may also comprise an elongated housing 107 comprising a proximal end 109 and a distal end 111, a first plate, such as a floorplate 122, a second plate, such as a lock plate 120, at least one follower 118, and a spring (not shown). In some embodiments, the floorplate 122 may be removably engaged with the proximal end of the housing 107. Further, the lock plate 120 may be configured to engage with the floorplate 122 and secure (or lock) the floorplate 122 at the proximal end of the housing. In some examples, the lock plate 120 may protrude through an opening in the floorplate 122 and may comprise one or more tactile features, such as raised ridges through the magazine floor-plate opening, which may allow for identifying and distinguishing different magazines. In some cases, the follower may move or slide within the housing of the magazine 104, through the compression and decompression of the spring (e.g., an accordion spring). Further, the follower 118 may be configured to support one or more cartridges 112. In some cases, the floorplate 122 may be removable to facilitate maintenance (e.g., cleaning, lubrication) of the magazine and for removal/replacement of its internal components.

In some cases, the magazine 104 may be loaded with one or more cartridges 112. In some cases, the housing 107 may be adapted to hold any desired number of cartridges (e.g., 5, 10, 30, etc.). Further, the magazine 104 may be adapted to hold and deliver any desired caliber of rifle or pistol cartridges into the chamber of the firearm 100, such as, but not limited to, 0.223 REMINGTON, 5.56 mm NATO, 0.300 BLK, 0.22 LR, 7.62×39 mm, or 7.62×51 mm NATO. In some cases, the cartridges 112 may be stacked vertically, and arranged in a one, two, four, etc., across configuration. In some embodiments, the cartridges may be staggered, and the cartridges in a particular row of the two or four across configurations may be at different heights (i.e., not level) with respect to one another.

According to an embodiment, the magazine 104 may be a polymer-based magazine. In some other cases, the magazine 104 may be made of metal, plastic, carbon fiber, fiberglass, and/or epoxy resin. It should be noted that any suitable material or combination of materials may be used for the magazine. In some cases, the magazine 104 may be made by injection molding, casting, forming (e.g., bending or stretching), and/or machining (e.g., milling). In some cases, the one or more springs within the magazine may be at a greatest compression when the magazine 104 is fully loaded.

Figure 2:
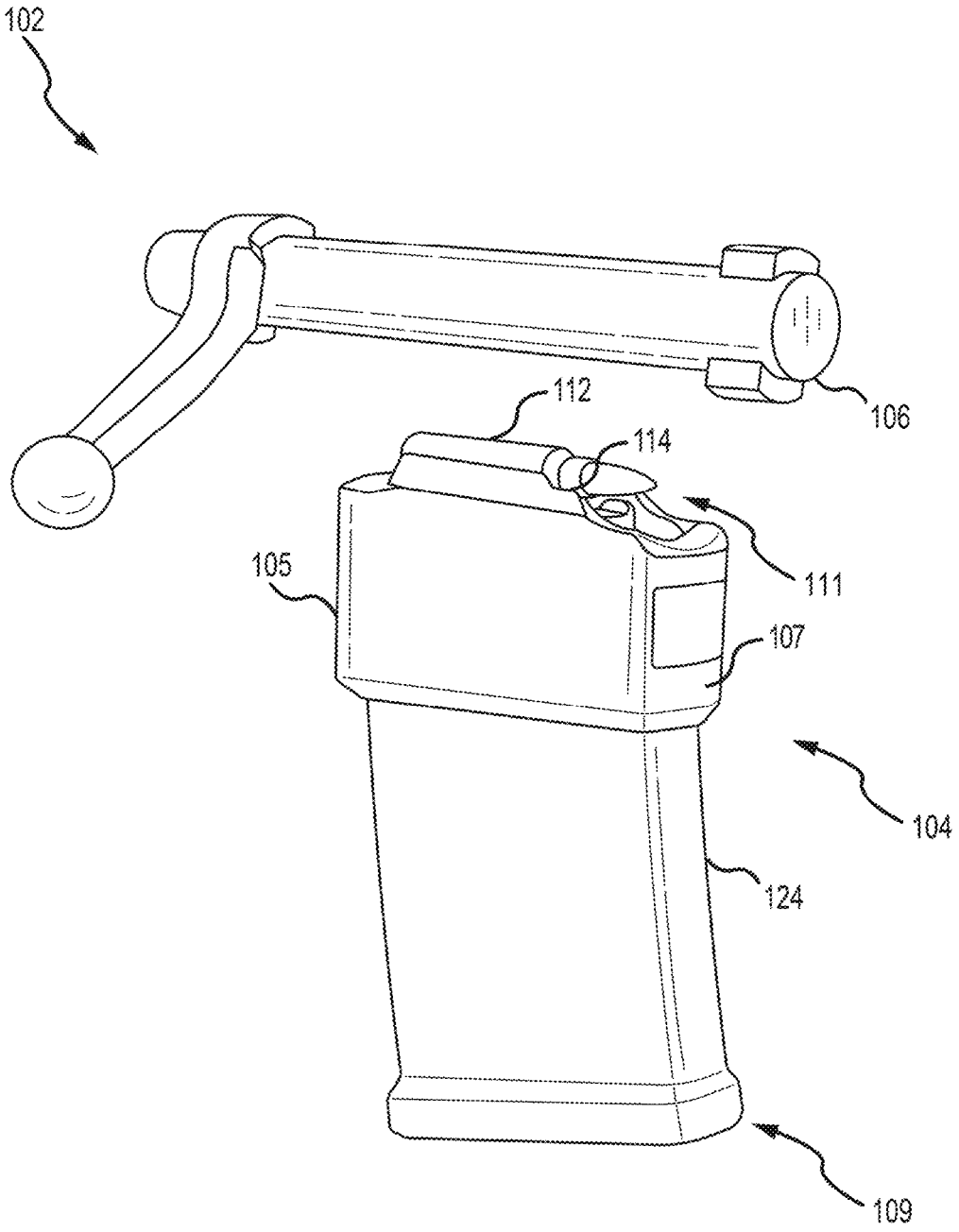
FIG. 2 is an exploded perspective view of the magazine assembly and bolt in FIG. 1, in accordance with one or more implementations.
Figure 3:
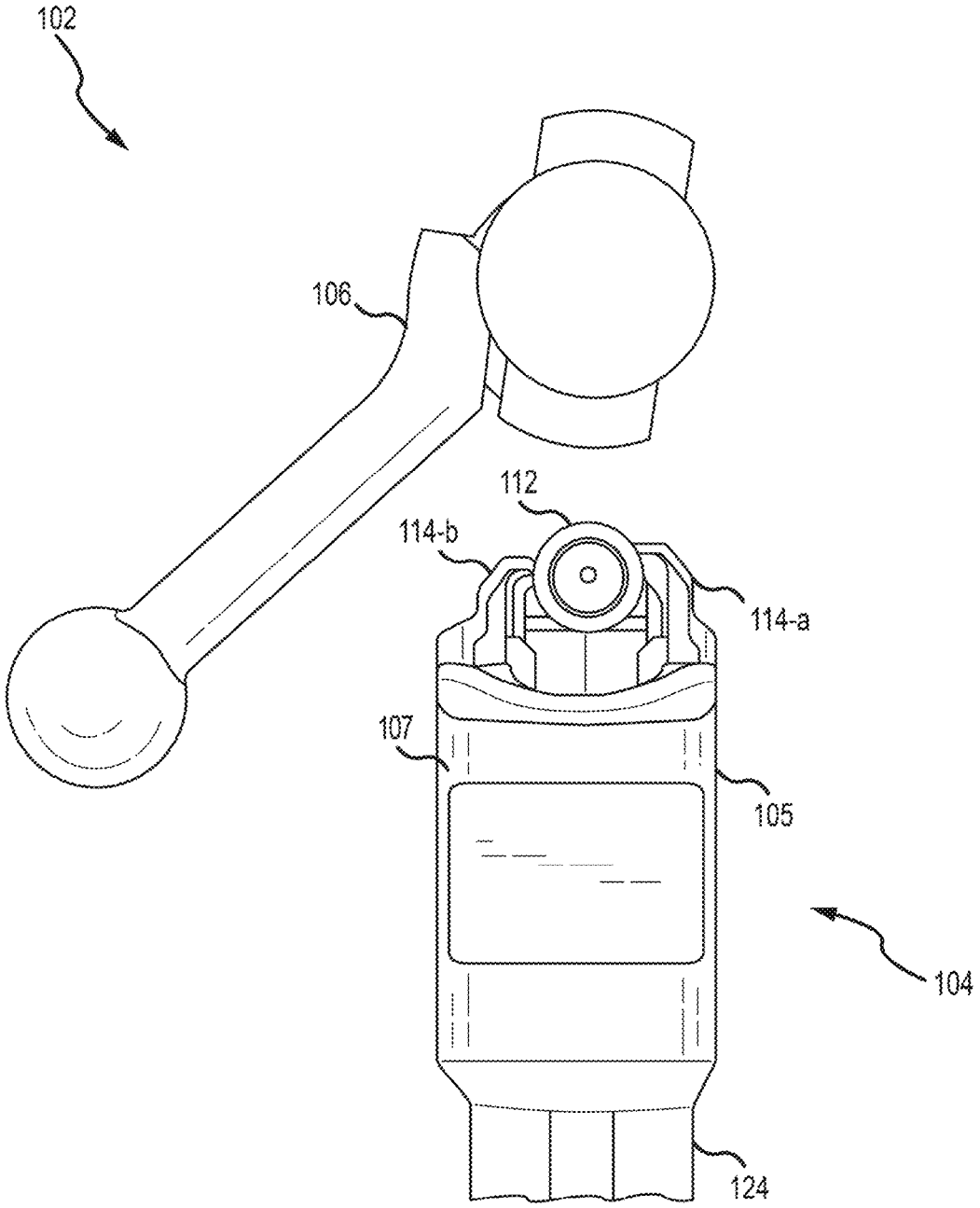
FIG. 3 is an exploded front section view of the magazine assembly and bolt in FIG. 1, in accordance with one or more implementations.

In some cases, the magazine housing 107, also referred to as a casing, may be hollow and elongated. Further, an inside of the magazine housing 107 shaped to guide the follower 118 may have a relatively constant length and width along a path of travel of the follower 118. As illustrated in FIGS. 2 and 3, the elongated housing 107 may comprise the narrow lower portion 124 towards the proximal end 109 and the upper bulged portion 105 towards the distal end 111, where the narrow lower portion 124 has a smaller outer width than the upper bulged portion 105. In some cases, the outer width of the upper bulged portion 105 may be based at least in part on an inner width of a magazine well of the firearm. For example, the upper bulged portion 105 of the magazine casing may be configured to fit within a width of the magazine well of the receiver (e.g., see receiver 130 in FIG. 1). In some cases, for instance, if the diameter of the topmost cartridge is similar or substantially similar to the cartridge diameter originally configured for use with the rifle, the topmost cartridge 112 supported on the follower 118 may be substantially aligned with the axis of the barrel 108 when the magazine 104 is properly inserted into the magazine well. In some other cases, a centerline of the topmost cartridge 112 may be misaligned or off-set (e.g., in a horizontal direction) with respect to a centerline of the bolt 106, a longitudinal axis passing through a center of the barrel, a centerline of the magazine well, and/or a centerline of the upper bulged portion 105, for instance, if the topmost cartridge 112 has a smaller diameter than cartridges originally configured for use with the firearm 100. In other words, the centerline of the topmost cartridge 112 may be in a vertical plane that is parallel to but laterally offset from a vertical plane passing through the centerline of the bolt and a center of the magazine well.

For the purposes of this disclosure, a centerline may refer to a perpendicular or vertical line (or plane) passing through a geometric center, or a point that is equidistant from the left and right edges (or surfaces), of a respective element (e.g., of a bolt, a topmost cartridge, magazine well, upper bulged portion, narrow lower portion, etc.). In some cases, an offset or misalignment may refer to a displacement, for instance, in a horizontal direction between centerlines of different elements of the magazine and/or firearm. In some embodiments, the displacement may be on the order of a few millimeters (e.g., 1 mm, 2 mm, etc.). Different displacements are contemplated in other embodiments, based on use case, cartridge dimensions, magazine dimensions, bolt dimensions, etc. In some examples, the cross-sections of the topmost cartridge 112 and the bolt 106 may be circles, due to their generally cylindrical shapes. In such cases, the centerline of the topmost cartridge may refer to a perpendicular line (or plane) passing through the center of its cross-section circle, and the centerline of the bolt may refer to a different perpendicular line (or plane) passing through the center of its cross-section circle. In this way, the centerline of the topmost cartridge (or bolt) may coincide with a diameter (i.e., vertical and perpendicular diameter) of its cross-section circle. Now, imagine another diameter (i.e., horizontal diameter perpendicular to the vertical diameter) for each of those cross-section circles. Each of these horizontal diameters may intersect the cross-section circle associated with a respective one of the topmost cartridge (or bolt) at two points, where these two points may be equidistant from the centerline of the topmost cartridge (or bolt), since the centerlines of the topmost cartridge (or bolt) coincide with a vertical diameter of their respective cross-section circles. In this case, an offset between the centerline of the topmost cartridge and the centerline of the bolt may refer to a horizontal displacement (e.g., along a y-axis) between the two vertical diameters discussed above.

Similarly, a centerline of the magazine well and a centerline of the upper bulged portion may refer to perpendicular lines (or planes) passing through points that are equidistant in the horizontal direction from the left and right vertical edges (or surfaces) of the magazine well and upper bulged portion, respectively. It should be noted that, a centerline of a narrow lower portion of the magazine may be defined in a similar manner to the centerline of the upper bulged portion and/or magazine well. In some cases, an offset from a centerline of the topmost cartridge and a longitudinal axis passing through a center of the barrel may refer to a displacement in the horizontal direction between the centerline of the topmost cartridge and a vertical plane parallel to and defined by the longitudinal axis of the barrel.

In some cases, the magazine 104 may comprise the proximal end 109 (also referred to as a bottom end) and the distal end 111 (also referred to as a top end). Further, feed lips 114 (e.g., feed lips 114-*a* and 114-*b*) may be formed at the top end of the magazine 104. As shown in FIG. 3, the feedlips 114-*a* and 114-*b* may be arranged on opposing sides of the elongated housing 107 and may be shaped and positioned above the upper bulged portion 105. In some aspects, the feed lips 114 may be designed to keep cartridges held within the magazine 104 until the cartridges 112 are fed from the magazine 104, such as by action of the firearm's bolt 106. In other words, the feed lips 114 may be adapted to prevent upward movement of a topmost of the one or more cartridges until the bolt 106 or a slide (not shown) chambers the topmost of the one or more cartridges. In some cases, the topmost cartridge 112 may be arranged off-center from the bolt 106 of the firearm (e.g., firearm 100 in FIG. 1) so as to increase an engagement or overlap between the bolt and the topmost cartridge 112.

Figures 13A, 13B:
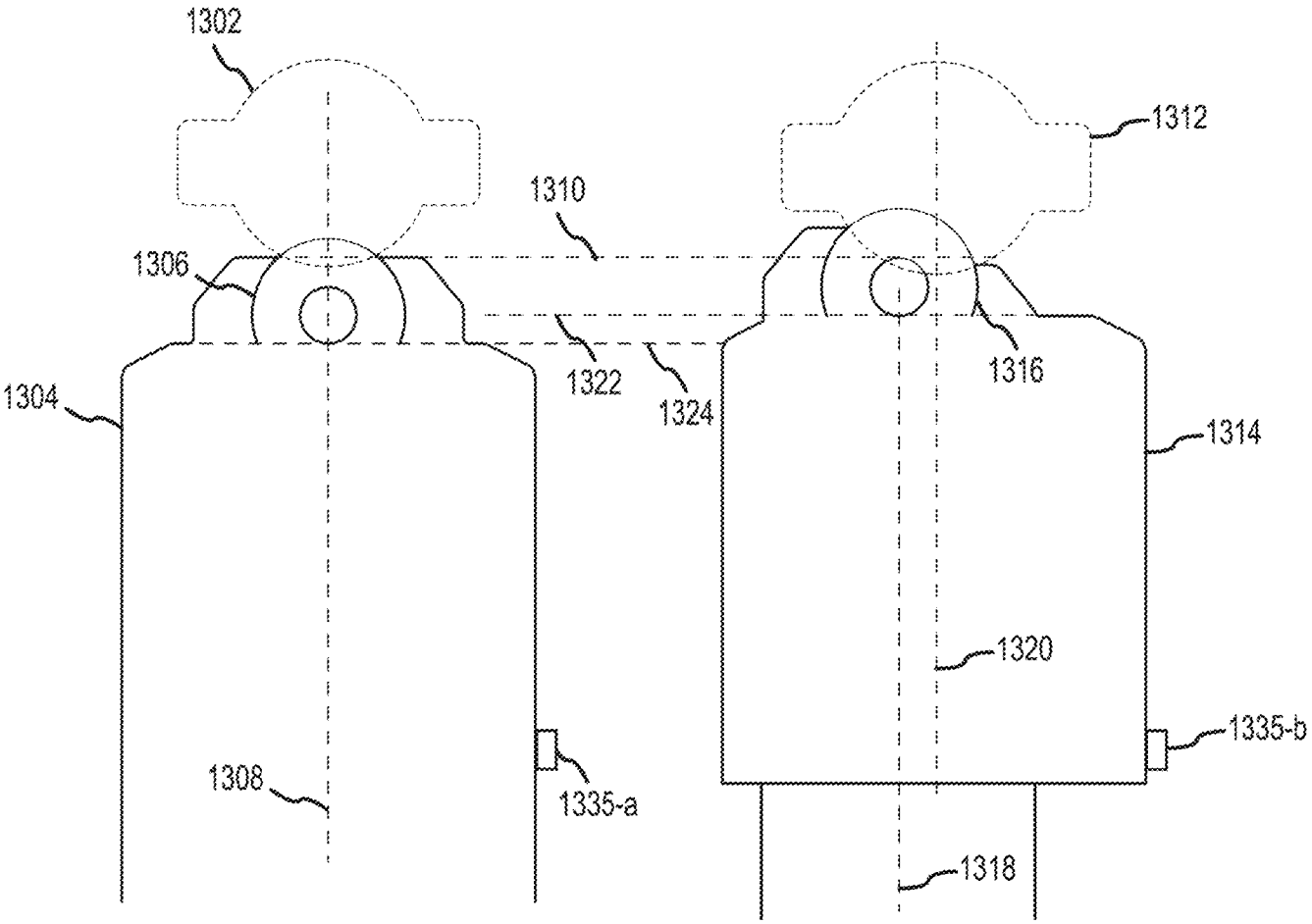
FIG.13A (PRIOR ART)
FIG. 13A illustrates a rear section view of a magazine assembly and bolt in the prior art.
FIG. 13B illustrates a rear section view of the magazine assembly and bolt in FIG. 1, in accordance with one or more implementations.

In some cases, cartridges 112 may be fed from the magazine 104 to the firearm 100 prior to and after the firearm is fired. As the cartridges 112 are fed, the cartridges 112 within the magazine 104 advance towards the feed lips 114 of the magazine. In some cases, such feeding typically occurs after a cartridge 112 is fired, and the bolt 106 of the firearm 100 is retracted. In some cases, the bolt 106 of the firearm 100 may be retracted by action of the user, or using recoil kinetic energy of the firearm, or through any other means. Moving the bolt 106 forward and into the chamber may strip the topmost cartridge 112 forward out of the magazine 104 and into the chamber. In some cases, this force may be known as the stripping force. Although this disclosure primarily discusses a bolt, in other embodiments, a slide can play a similar role (e.g., in pistols utilizing aspects of this disclosure).

Where a magazine storing smaller cartridges is used in a firearm designed for use with larger cartridges, the magazine may include an upper bulge 105 having dimensions matched to the firearm's magazine well, and a narrow lower end 124 having smaller dimensions reflecting the smaller cartridges in the magazine 104. In some cases, the feed lips 114-*a* and 114-*b* of the magazine 104 may be asymmetric with respect to one another (e.g., see FIGS. 3, 8, 9, and 10), for instance, by placing them at different heights. Additionally or alternatively, the feed lips may have different dimensions (e.g., length or curvature) or feedlip geometry. In some other cases, the feed lips 114-*a* and 114-*b* may be made of materials with different rigidity or elasticity, for instance, one feedlip may be composed of steel and the other of a polymer, to name just one non-limiting example. In yet other cases, the feedlips 114-*a* and 114-*b* may not be equidistant from the centerline of the bolt, further illustrated in FIGS. 10 and 13B. For instance, inner surfaces of the feedlips 114-*a* and 114-*b* may be at different horizontal distances from the centerline of the bolt and/or upper bulged portion 105. Additionally or alternatively, the outer surfaces of the feedlips 114-*a* and 114-*b* may be at different horizontal distances from the outer edge or surface of the upper bulge 105, as also shown in FIGS. 10 and 13B. In some other cases, the points at which the inner and/or outer surfaces of a first feedlip (e.g., feedlip 114-*a*), and the points at which the respective inner and/or outer surfaces of the second feedlip (e.g., feedlip 114-*b*) intersect the housing may not be equidistant from the centerline of the bolt, upper bulge, etc. In some other cases, one feedlip (e.g., feedlip 114-*a*) may be wider than the other feedlip (e.g., feedlip 114-*b*).

Figure 4:
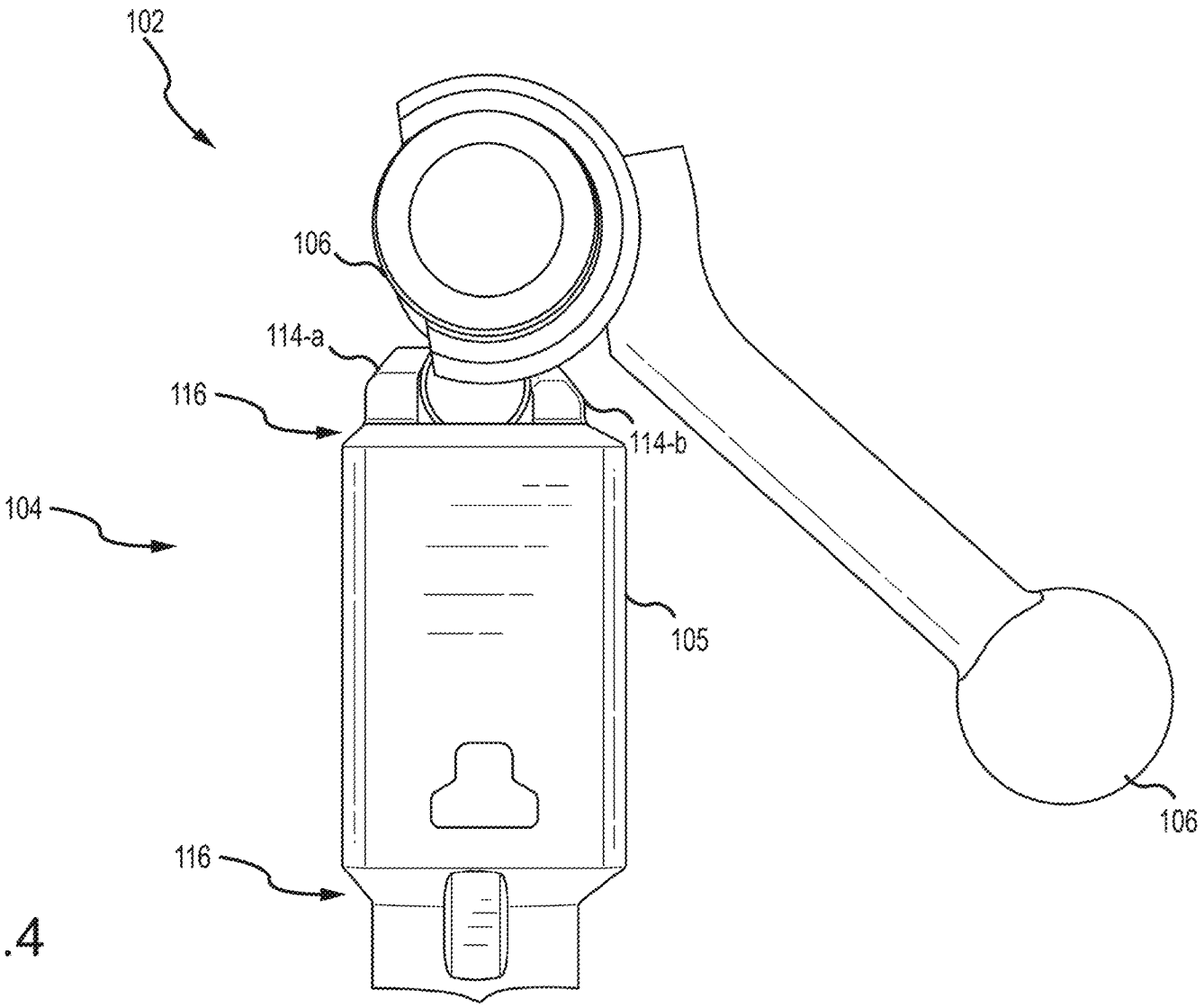
FIG. 4 is rear section view of the magazine assembly and bolt in FIG. 1, in accordance with one or more implementations.
Figure 5:
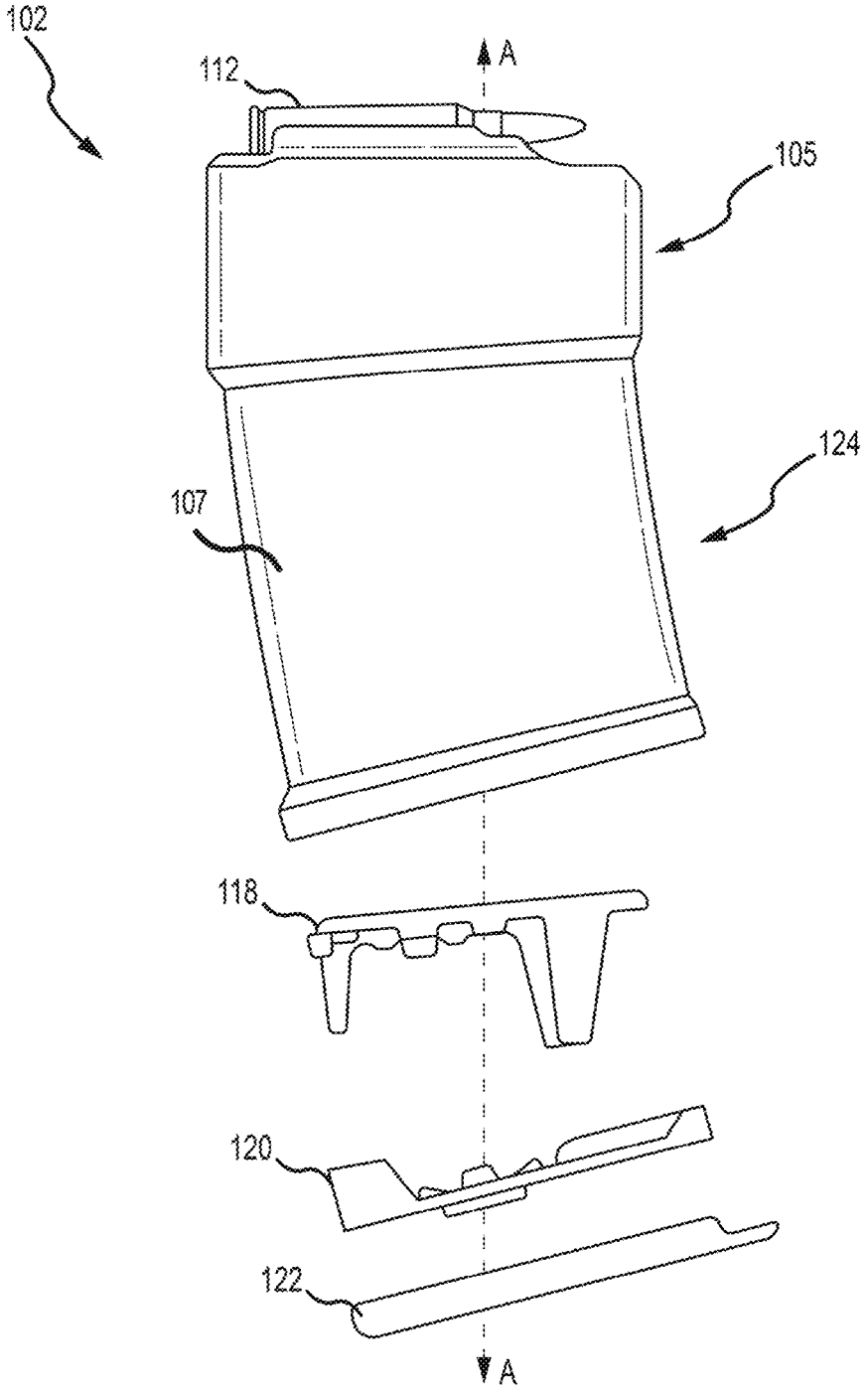
FIG. 5 is an exploded side section view of the magazine assembly in FIG. 1, in accordance with one or more implementations.
Figure 6:
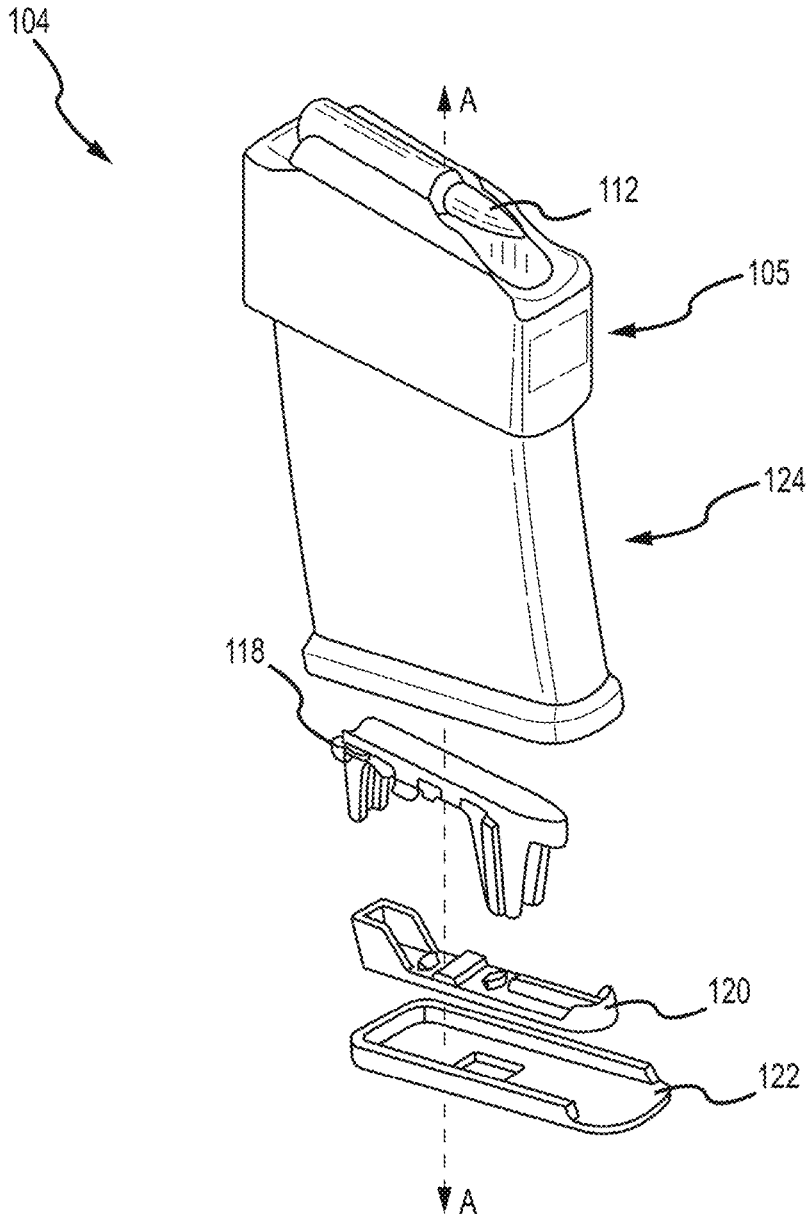
FIG. 6 is an exploded top perspective view of the magazine assembly in FIG. 1, in accordance with one or more implementations.
Figure 7:
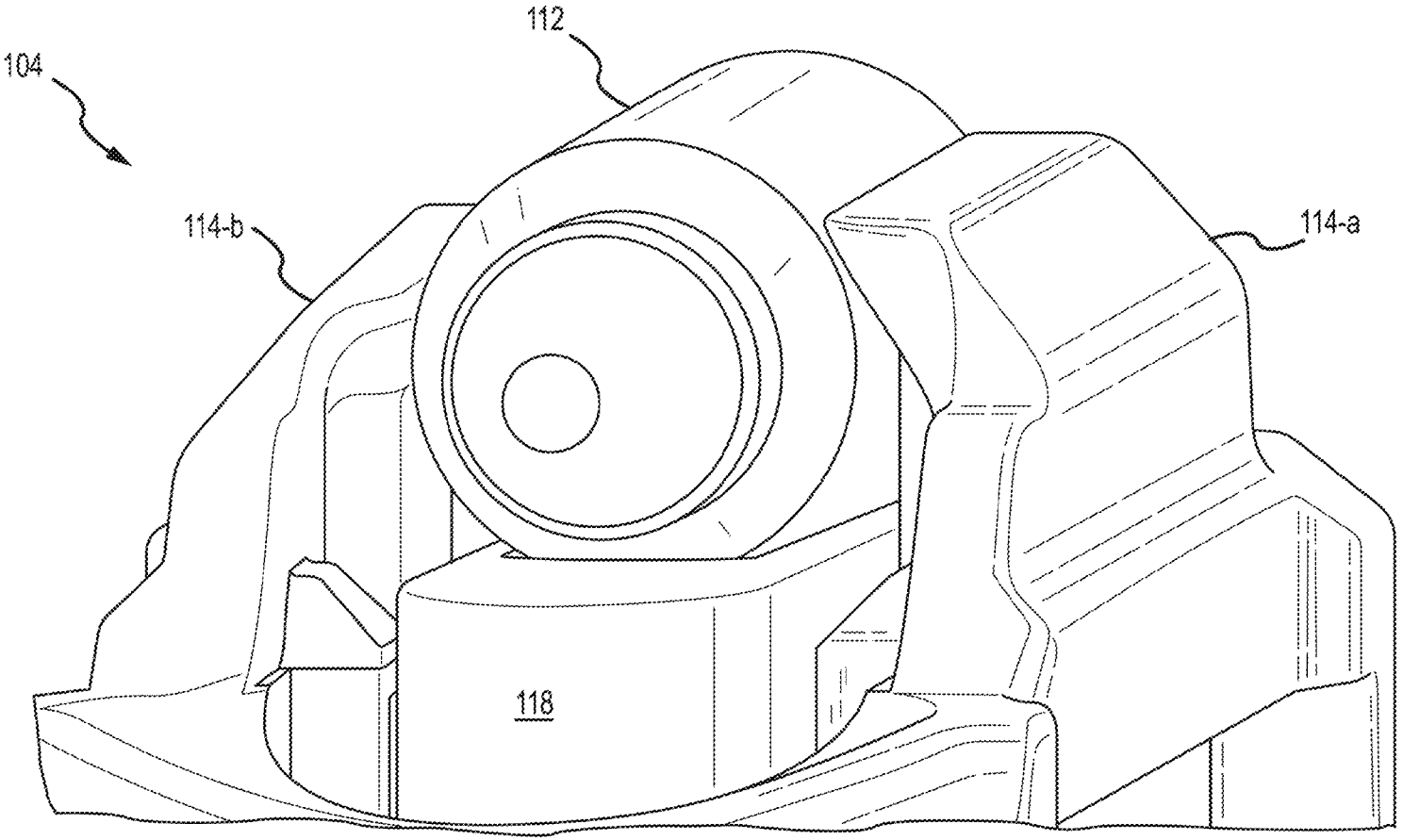
FIG. 7 is a detailed front perspective view of the magazine assembly in FIG. 1 illustrating the asymmetric body and feed lips, in accordance with one or more implementations.
Figure 8:
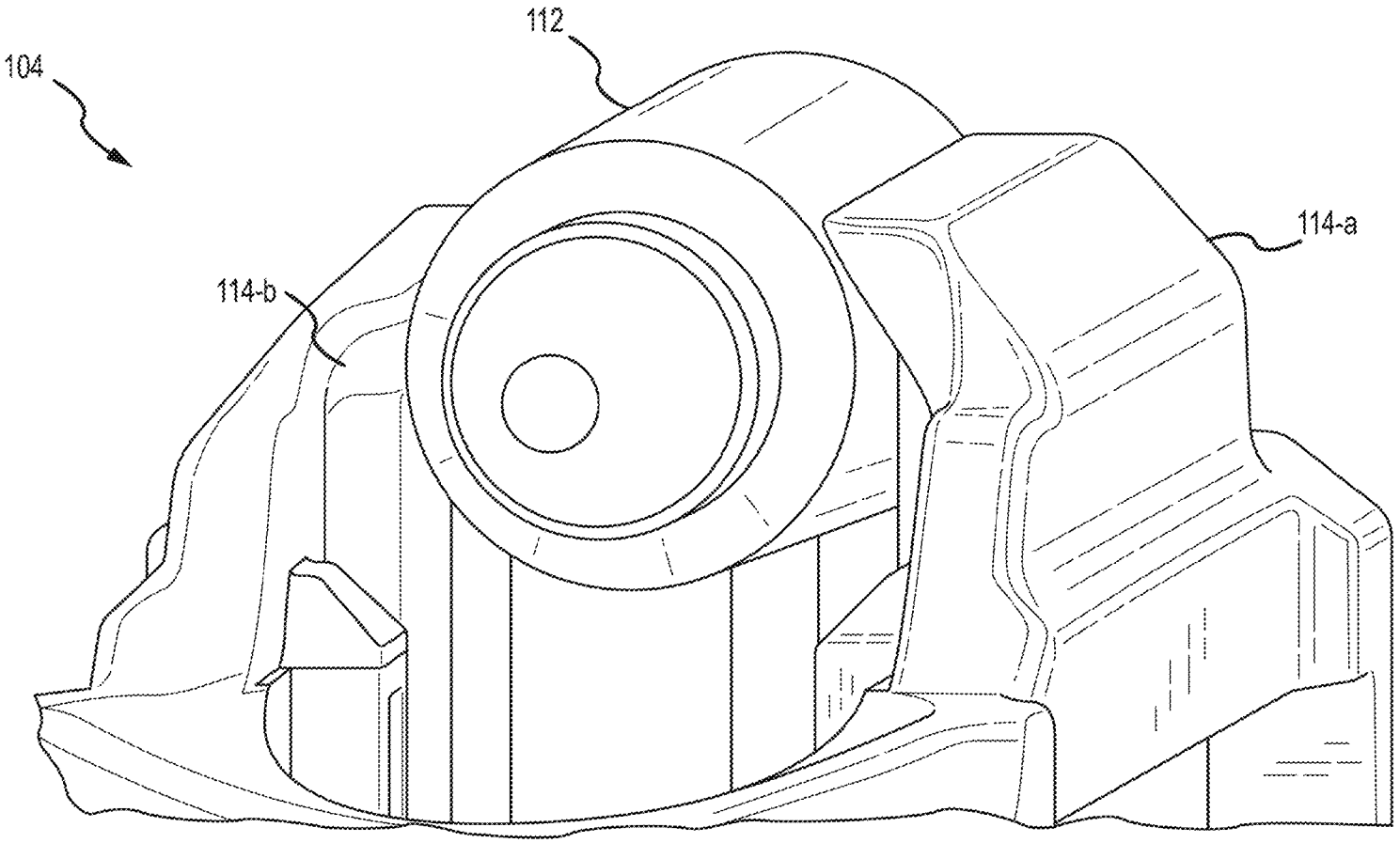
FIG. 8 is a detailed front perspective view of the magazine assembly in FIG. 1 illustrating the asymmetric body and feed lips, in accordance with one or more implementations.
Figure 9:
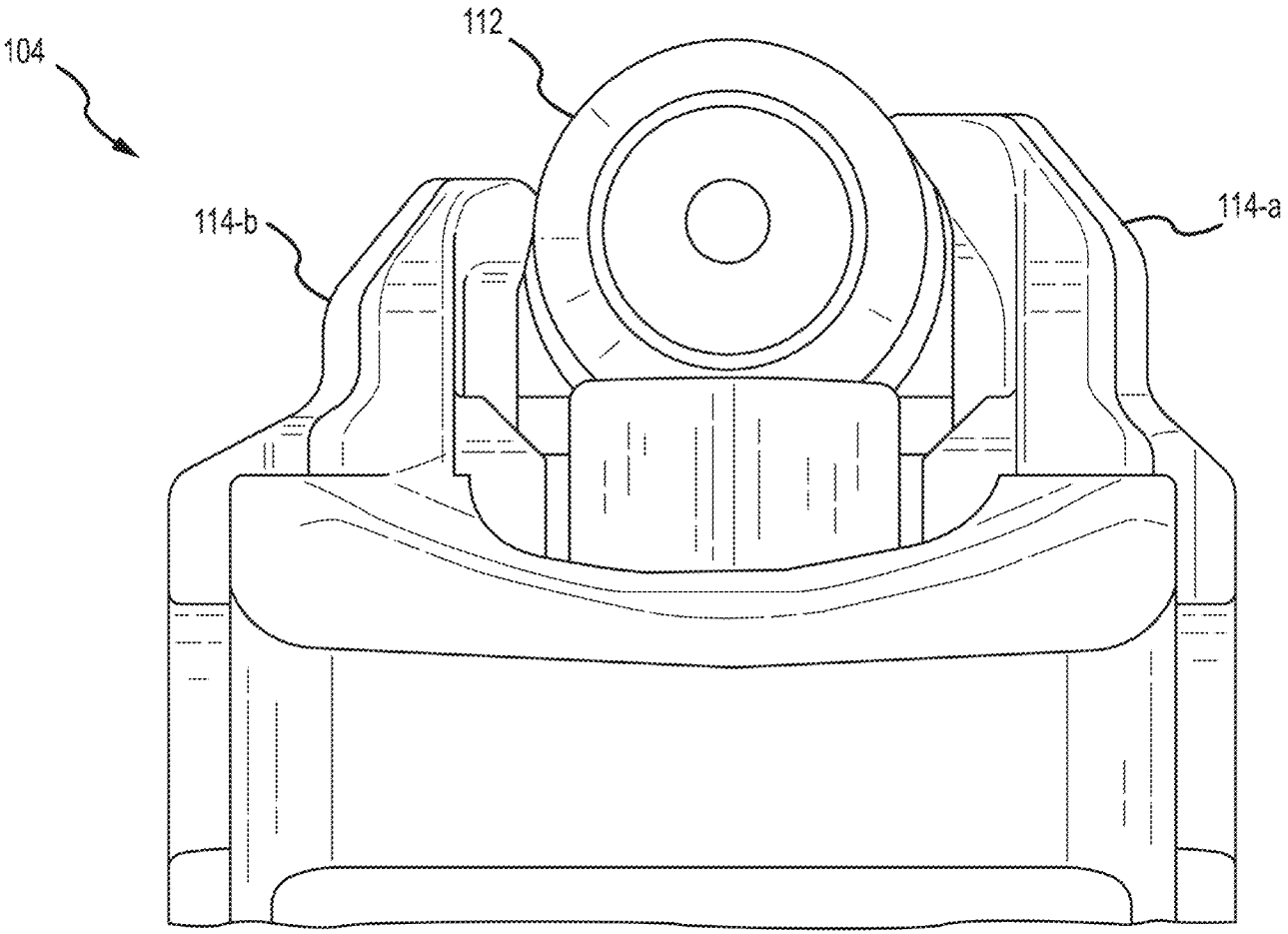
FIG. 9 is a detailed front view of the magazine assembly in FIG. 1 illustrating the asymmetric body and feed lips, in accordance with one or more implementations.
Figure 10:
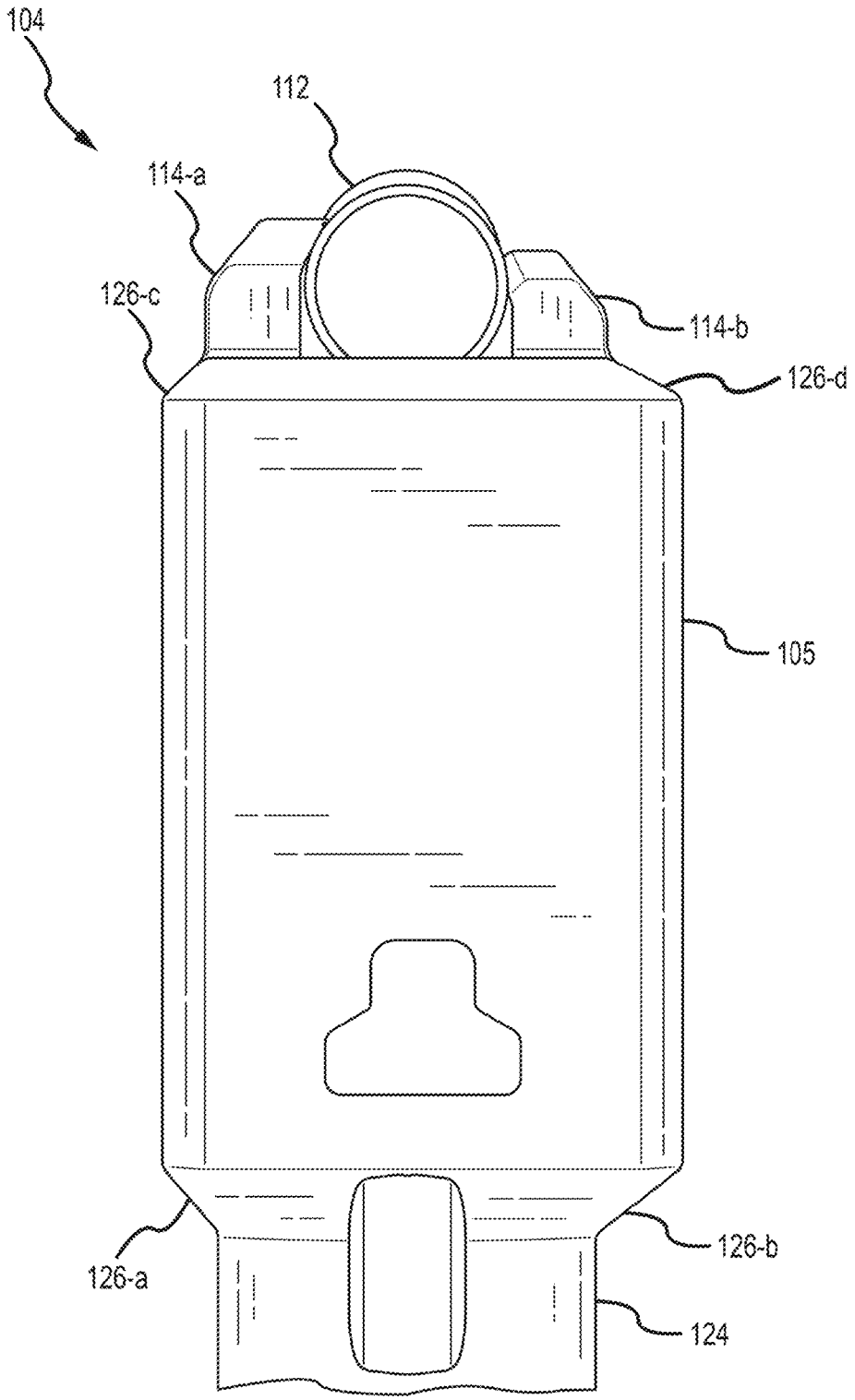
FIG. 10 is a rear view of the magazine assembly in FIG. 1 illustrating the asymmetric body and feed lips, in accordance with one or more implementations.
Figure 11:
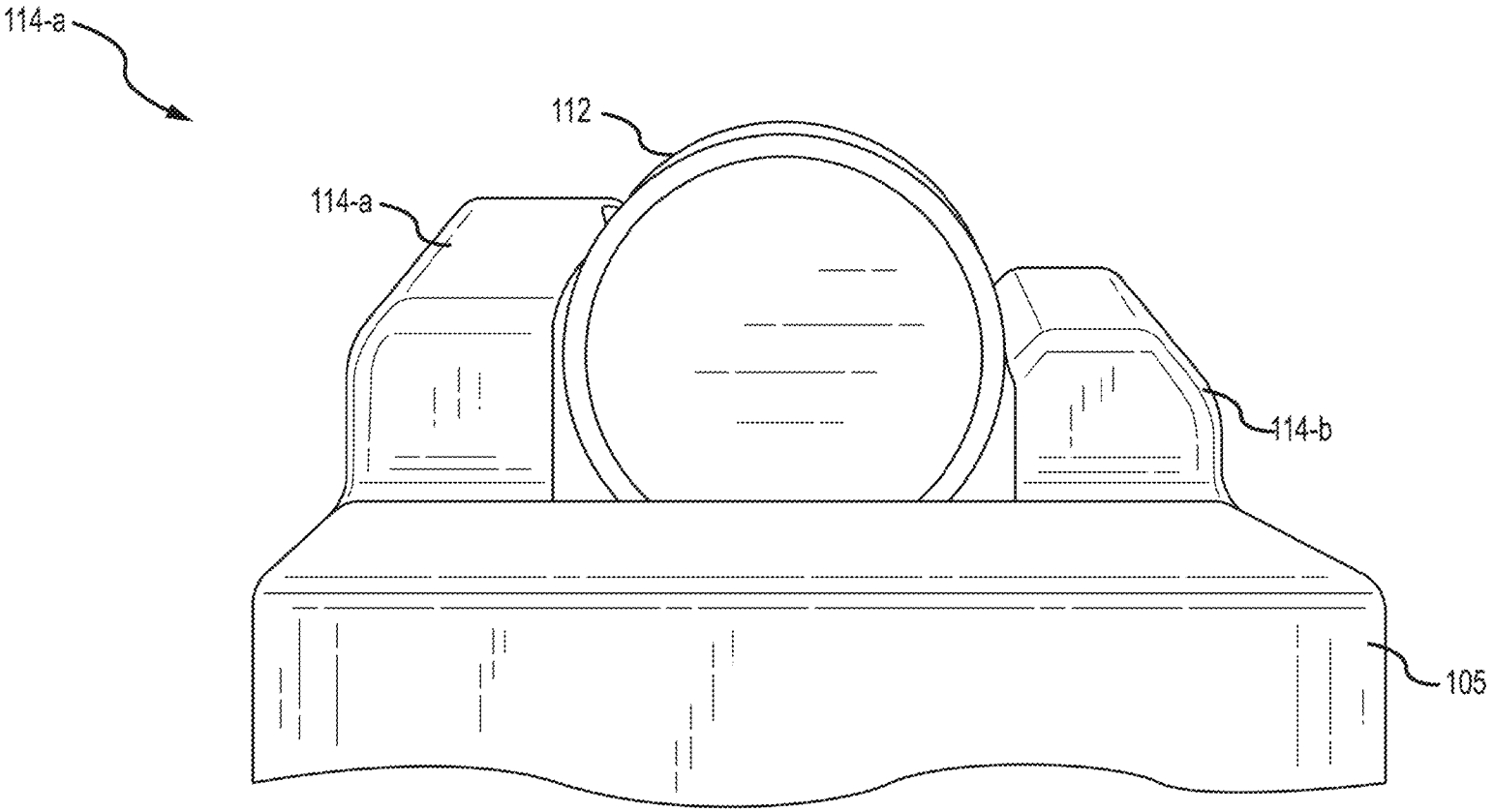
FIG. 11 is a detailed rear view of the magazine assembly in FIG. 1 illustrating the asymmetric body and feed lips, in accordance with one or more implementations.

Additionally or alternatively, in some examples, the magazine body may be asymmetric relative to the narrow lower portion 124 (see, especially FIGS. 3 and 9). For instance, the elongated housing 107 may be shaped such that the upper bulged portion 105 is asymmetric with respect to the narrow lower portion 124. As an example, and as illustrated in at least FIGS. 3, 4, 10, and 13, the left and right vertical edges of the narrow lower portion 124 may be at different distances from the respective left and right vertical edges of the upper bulged portion 105, leading to an asymmetry between the upper bulge 105 and the narrow lower end 124. In some embodiments, the centerline of the narrow lower portion 124 may coincide with a centerline of the cartridges supported on the follower, for instance, in a single-stack magazine. In such cases, the centerline of the cartridges (including the topmost cartridge) may be off-set (or off-center) from the centerline of the upper bulged portion (i.e., since the centerlines of the upper bulge and narrow lower end may not coincide). Further, as shown in FIG. 4, the tapered portions 116 of the housing of the magazine (i.e., magazine body) may be asymmetric. This asymmetry may exist in two fashions: a left and right side of the taper may be asymmetric, and/or the taper at the top and bottom of the upper bulge 105 may be asymmetric.

In some embodiments, the elongated housing 107 may comprise first and second distal tapers arranged on opposing sides of the housing and extending at first and second distal angles, respectively, in an upward direction from the upper bulged portion 105, further described in relation to FIG. 10. In some cases, the first distal angle may be different from the second distal angle. Similarly, the elongated housing 107 may also comprise first and second proximal tapers arranged on opposing sides of the housing and extending at first and second proximal angles, respectively, between the upper bulged portion 105 and the narrow lower portion 124, where the first and second proximal angles may be different, further described in relation to FIG. 10. It should be noted that, the first proximal and distal tapers may be arranged on a first side of the elongated housing, while the second proximal and distal tapers may be arranged on a second side of the elongated housing, where the first and second sides are different (or opposing) sides of the housing. In some embodiments, a length of the first proximal and distal tapers may be different. Additionally or alternatively, the first proximal and distal angles may be different. In some embodiments, a length of the second proximal and distal tapers and/or the second proximal and distal angles may also be different.

FIG. 10 is a rear view of the magazine 104 illustrating the asymmetric feed lips 114-*a* and 114-*b* arranged on opposing sides of the elongated housing (i.e., magazine body). Further, as illustrated, magazine 104 may comprise an asymmetrical magazine body, since the left and right vertical edges (or surfaces) of the narrow lower portion 124 may be at different distances from the respective left and right vertical edges (or surfaces) of the upper bulged portion 105. Accordingly, there may exist an asymmetry between the upper bulge 105 and the narrow lower end 124 of the magazine body. In some cases, the centerlines of the upper bulge and narrow lower portion may not coincide. Furthermore, in some embodiments, the centerline of the narrow lower portion 124 may coincide with a centerline of the cartridges supported on the follower, for instance, in a single-stack magazine. It should be noted that other cartridge stacking configurations (e.g., dual stack, staggered, etc.) are contemplated in different embodiments.

In some examples, one or more tapered sections may also impart asymmetry to the magazine body or housing. For instance, as shown, first and second proximal tapers (e.g., tapers defined by first and second proximal angles 126-*a* and 126-*b*) may extend at first and second proximal angles, respectively, between the narrow lower portion 124 and the upper bulged portion 105 of the magazine 104. Contrary to typical magazine designs, however, the tapered portions of the magazine body may be substantially asymmetric with respect to the narrow lower portion 124 and the upper bulged portion 105 of the magazine. In other words, the left and right sides of the lower tapered portion of the magazine body may be at different angles (i.e., proximal angle 126-*a* and proximal angle 126-*b* are different) with respect to the narrow lower end 124, and the left and right sides of the upper tapered portion may be at different angles (i.e., distal angle 126-*c* and distal angle 126-*d* are different) with respect to the upper bulged portion 105 of the magazine 104. In some aspects, the upper bulged portion 105 may be slightly skewed in one direction (e.g., to the right of the page in FIG. 10), due to different first and second proximal angles and/or different first and second distal angles. In some circumstances, the first proximal and distal angles 126-*a* and 126-*c*, respectively, may be of equal or approximately equal value (e.g., 45 degrees, 50 degrees, 60 degrees, etc.). Further, the second proximal and distal angles 126-*b* and 126-*d*, respectively, may be of equal or approximately equal value (e.g., 30 degrees, 35 degrees, etc.).

In some examples, the centerline of the upper bulge 105 (e.g., see centerline 1320 in FIG. 13) may be configured to coincide with the centerline of the magazine well, which may allow the magazine 104 to securely fit within the magazine well of the receiver. Further, the centerline of the magazine well may be the same as the centerline of the bolt 106. In other words, the centerlines of the upper bulge 105, the magazine well, and the bolt 106 may all coincide. Further, a longitudinal axis passing through a center of the barrel may also coincide with the centerline of the bolt 106. However, a centerline of the topmost cartridge may not be aligned with this centerline and may therefore be offset from the bolt when viewed from above, further described in relation to FIG. 12. In some examples, a centerline of the narrow lower portion 124 may not coincide with one or more of the centerline of the upper bulge portion 105, the magazine well, and the bolt 106.

As further described with reference to FIG. 12, the centerline of topmost cartridge 112 of the magazine 104 may be offset (e.g., horizontally or along a horizontal plane) relative to the centerline of the magazine 104, the bolt 106, or both. It should be noted that, each centerline may be associated with or defined by a vertical plane passing through the horizontal center of a respective one of the topmost cartridge, bolt, etc., where the centerline is parallel to and a part of said vertical plane. Said another way, a centerline or centerplane of an element may be equidistant (horizontally) from the left and right edges (or surfaces) of the respective element (e.g., topmost cartridge or bolt). In some cases, such a configuration may serve to enhance feeding of the cartridges 112 into the chamber of the rifle by increasing the bolt-cartridge overlap or engagement, as well as minimizing follower dive.

Figure 12:
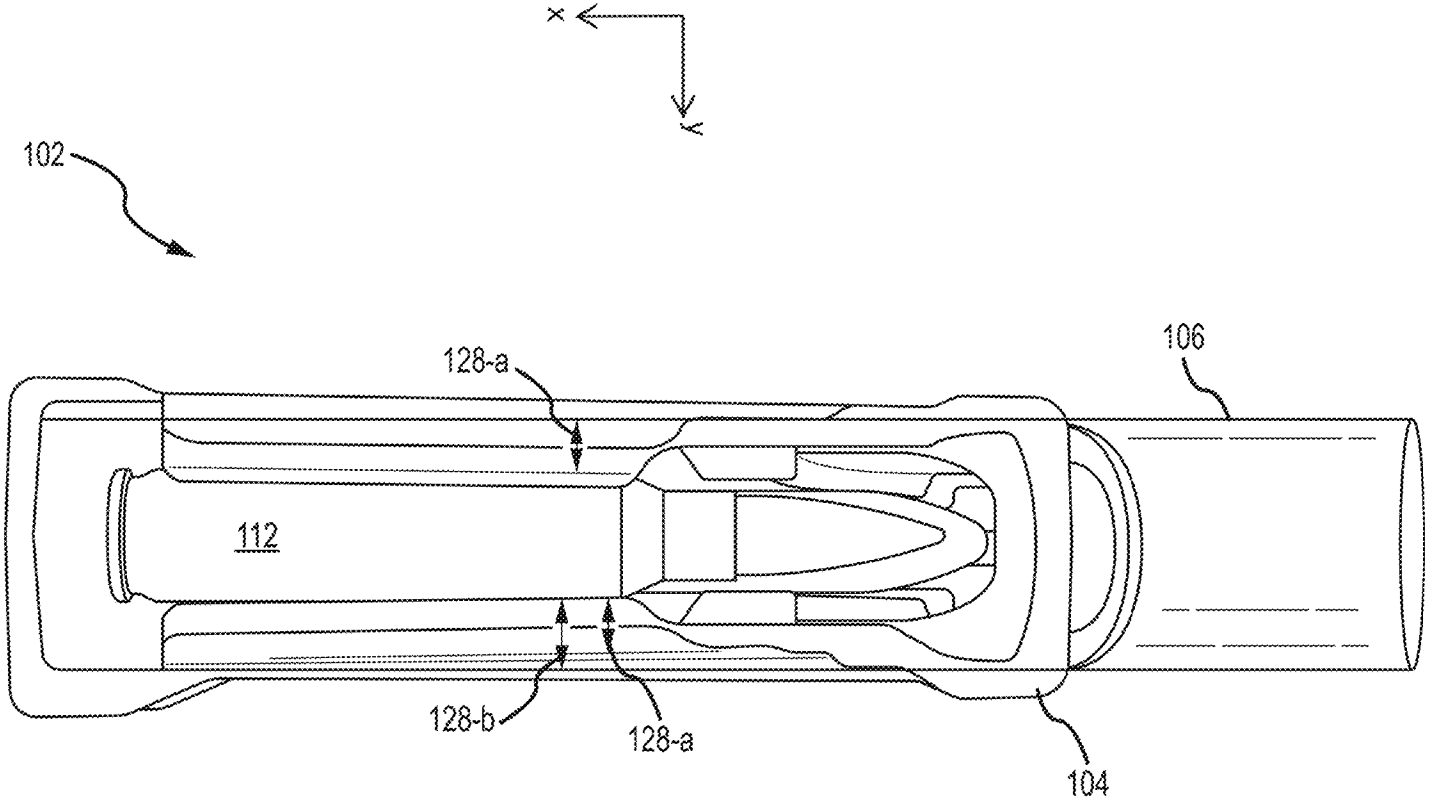
FIG. 12 is a top view of the magazine assembly in FIG. 1, in accordance with one or more implementations.

FIG. 12 is a top view of the magazine-bolt group 102 illustrating the asymmetric placement of the topmost cartridge 112 with respect to the bolt 106. In some cases, the bolt 106 may be sized for engaging cartridges of a first caliber and may successfully extract a cartridge of this size even when the cartridges are aligned with a centerline of the bolt. However, issues such as jamming or misfeeding may arise while attempting to use cartridges of a second and smaller caliber with such a bolt (i.e., when topmost cartridge 112 and a centerline of the bolt align, the bolt 106 may not properly engage the topmost cartridge 112 in the magazine 104). In order to mitigate this, the feedlips (e.g., feedlips 114-*a* and 114-*b* in FIG. 11) may be arranged such that the topmost cartridge 112 is offset from a centerline of the upper bulge 105 and also from a centerline of the bolt 106 prior to feeding. This offset along with positioning the topmost cartridge higher up in the firearm may enable a greater area of overlap between the bolt 106 and the topmost cartridge 112, as shown in FIG. 13B, thereby reducing the chances of the bolt failing to extract the topmost cartridge 112. In some circumstances, magazines may comprise one or more magazine stops (or simply, mag stops or stops) configured to interact with a portion of the magazine well. These mag stops may set a stopping point of the magazine when inserted upward into the magazine well. According to aspects of the current disclosure, these mag stops may be positioned lower on the magazine 104, as compared to a typical magazine (said another way, a top surface of a magazine stop may be arranged further from a top of a higher of the two feedlips than this same distance in a traditional magazine without asymmetric feedlips). In this way, the mag stop in magazine 104 may be positioned further away, in a vertical direction, from a top of the feedlips, as compared to a vertical distance between a mag stop and a top of the feedlips in typical magazines. This allows for the topmost cartridge to be positioned higher in the magazine well relative to the bolt than in traditional systems. Further, positioning the mag stop lower on the magazine 104, as compared to a typical magazine, may also allow the magazine to be inserted higher up within the magazine well of the firearm. Accordingly, the topmost cartridge 112 may also be positioned higher up in the firearm, which may allow for a greater degree of overlap between the bolt and the topmost cartridge.

As shown, the left surface of the topmost cartridge 112 (toward a center of the page) is a distance 128-*a* away from the left surface of the bolt 106 along the y-axis, and the right surface of the topmost cartridge 112 is a distance 128-*b* away from the right surface of the bolt 106 along the y-axis. In some embodiments, the distance 128-*a* may be shorter than distance 128-*b*, as also seen via the reproduction of distance 128-*a* on the right surface for comparison only. Accordingly, there may exist an offset between the centerline of the bolt 106 and the centerline of the topmost cartridge 112 in the magazine since the longitudinal surfaces of the topmost cartridge 112 are not equidistant from the respective longitudinal surfaces of the bolt 106. In some examples, since the topmost cartridge 112 in the magazine 104 is offset along the y-axis relative to the bolt 106, the topmost cartridge may also be offset relative to the centerline of magazine 104 as the centerlines of magazine 104 and bolt 106 coincide when viewed from above. In other words, the y-coordinate of the centerline of the topmost cartridge 112 in FIG. 12 may be different from the y-coordinate of the centerline of the magazine 104 (especially its upper bulge), as well as the y-coordinate of the centerline of the bolt 106. As noted above, since the centerline of the magazine 104 and the centerline of the bolt 106 may coincide when viewed from above, they may also share the same y-coordinate.

FIG. 13A illustrates a rear section view of a magazine assembly 1304 and a bolt 1302 in the prior art. Magazine assembly 1304 further illustrates an optional mag stop 1335-*a*. FIG. 13B illustrates a rear section view of a magazine assembly 1314, a bolt 1312, and an optional mag stop 1335-*b* in accordance with one or more implementations. In some cases, FIG. 13B may implement one or more aspects of the figures described herein, including at least FIGS. 1, 4, and 10. As shown, the magazine assembly 1304 in FIG. 13A (prior art) may comprise a centerline 1308 (also referred to as a center plane), which may coincide with the centerline of a topmost cartridge 1306 and the centerline of the bolt 1302. Contrastingly, the narrow lower portion of the magazine assembly 1314 in FIG. 13B may comprise a first centerline 1318, which may coincide with the centerline of the topmost cartridge 1316. Further, the upper bulged portion of the magazine assembly 1314 may comprise a second centerline 1320, which may be different from the first centerline 1318. In some cases, the centerline of the upper bulged portion may coincide with a centerline of the bolt 1312, a centerline of the magazine well (not shown), and/or a longitudinal axis passing through the barrel of the firearm (not shown).

In some cases, this centerline offset along with positioning the topmost cartridge 1316 higher up in the firearm (i.e., with respect to the vertical position of the topmost cartridge 1306 in the prior art) may enable a greater area of overlap between the bolt 1312 and the topmost cartridge 1316, thereby reducing the chances of the bolt failing to extract the topmost cartridge 1316. For instance, as illustrated in FIGS. 13A and 13B, a plane 1324 tangential to a bottom surface of the topmost cartridge 1306 may be lower (i.e., with respect to the distal end of the housing) than a plane 1322 tangential to a bottom surface of the topmost cartridge 1316. In other words, the topmost cartridge 1312 in FIG. 13B may be higher up in the firearm than the topmost cartridge 1306 in the prior art, which may serve to alleviate bolt face overlap issues by maximizing bolt face engagement.

In some cases, magazines may comprise one or more mag stops (e.g., mag stop 1335-*a*, mag stop 1335-*b*) configured to contact a downward-facing surface or edge of the magazine well. These mag stops may establish a height that a magazine is set into the magazine well. According to aspects of the current disclosure, mag stop 1335-*b* may be positioned lower on the magazine 1314 (i.e., with respect to a top of its feedlips), as compared to the position of the mag stop 1335-*a* on magazine 1304 (i.e., with respect to a top of its feedlips). In this way, the mag stop 1335-*b* in magazine 1314 may be positioned further away, in a vertical direction, from a top of its feedlips, as compared to the prior-art magazine. In some aspects, positioning the mag stop 1335-*b* lower on the magazine 1314 may also allow the magazine 1314 to be inserted higher up within the magazine well of the firearm, as compared to a typical magazine. Accordingly, and as illustrated, the topmost cartridge 1316 may also be positioned higher up in the firearm, which may allow for a greater degree of overlap between the bolt 1312 and the topmost cartridge 1316.

As previously described, the magazine 1314 according to the present disclosure may also comprise asymmetrical feedlips (e.g., feedlips 114-*a* and 114-*b* in FIG. 11), where the feedlips are positioned at different heights with respect to the proximal end of the housing. It should be noted that, the feedlips may be shaped and positioned above the upper bulged portion 105. In contrast, the feedlips of magazine 1304 in FIG. 13A may be positioned at the same height with respect to the bottom or proximal end of the housing, as shown by a plane 1310 tangential to the top surface of the feedlips.

Figure 14:
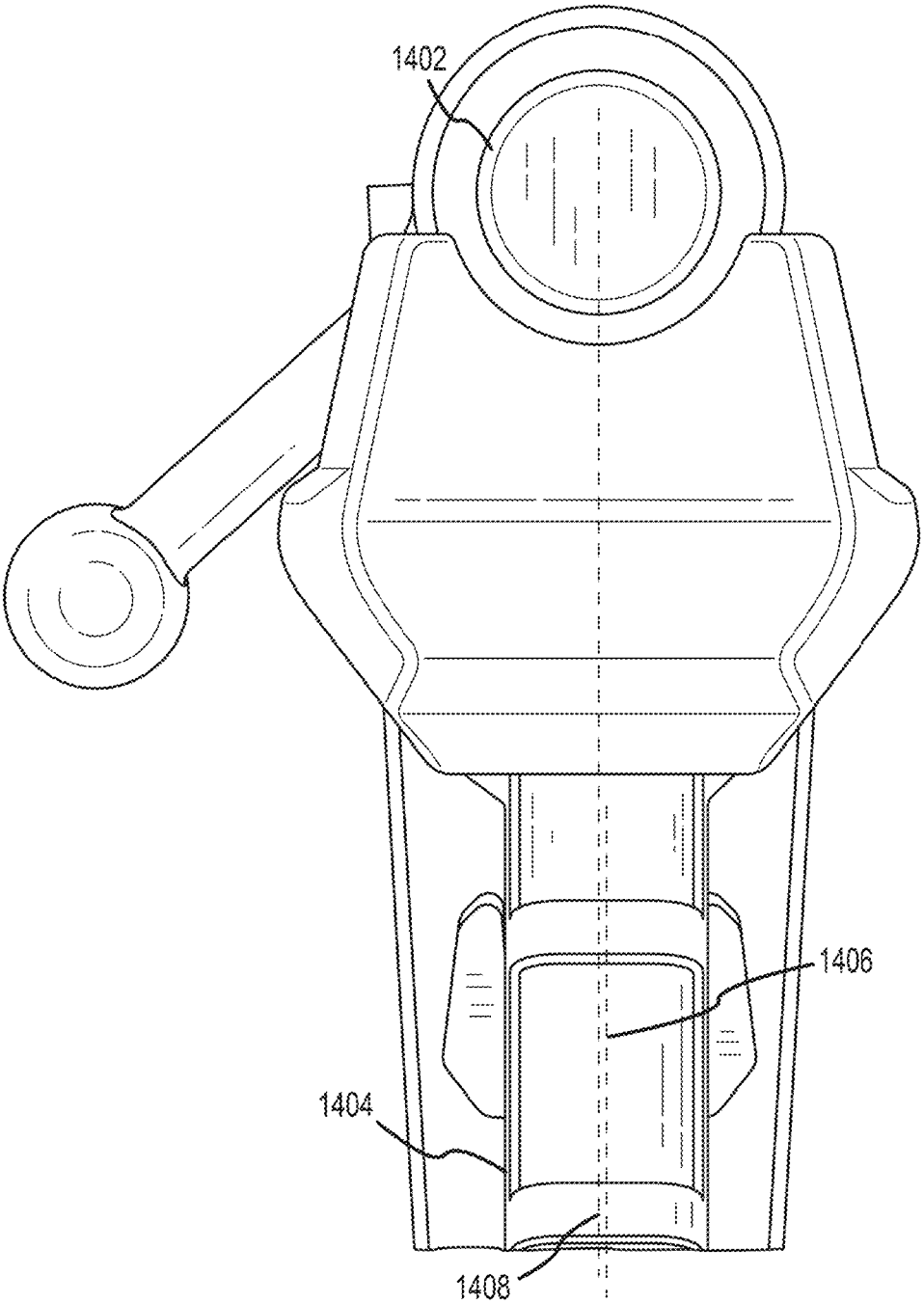
FIG. 14 illustrates a rear view of a magazine assembly and a bolt according to an alternate embodiment of the disclosure.

FIG. 14 illustrates a rear view of a magazine assembly 1404 and a bolt 1402 according to an alternate embodiment of the disclosure. FIG. 14 may implement one or more aspects of the figures described herein, including at least FIGS. 1, 4, and/or 10.

As shown, a centerline 1406 of the narrow lower end of the magazine assembly 1404 may not coincide with a centerline 1408 of the bolt 1402. In some cases, the centerline 1406 of the narrow lower end may or may not coincide with a centerline of the topmost cartridge (not shown) on the follower. In some cases, the centerline 1408 of the bolt may also be off-set or misaligned with respect to the centerline of the topmost cartridge. Further, the centerline 1408 of the bolt may or may not coincide with the upper bulged portion of the magazine assembly 1404. Additionally or alternatively, the centerline of the upper bulged portion may be misaligned with respect to the centerline 1406 of the narrow lower portion. In yet other cases, the centerline of the upper bulged portion and the narrow lower portion (i.e., a centerline of the magazine assembly 1404) may coincide with a centerline of the topmost cartridge, where this common centerline (e.g., centerline 1406) may be off-set from the centerline 1408 of the bolt 1402. In some aspects, the various configurations discussed in relation to FIG. 14 and the other figures described herein may serve to optimize cartridge feeding by forcing the topmost cartridge in the magazine to be slightly off-set from the bolt 1402, thus alleviating bolt face overlap issues.

Figure 15:
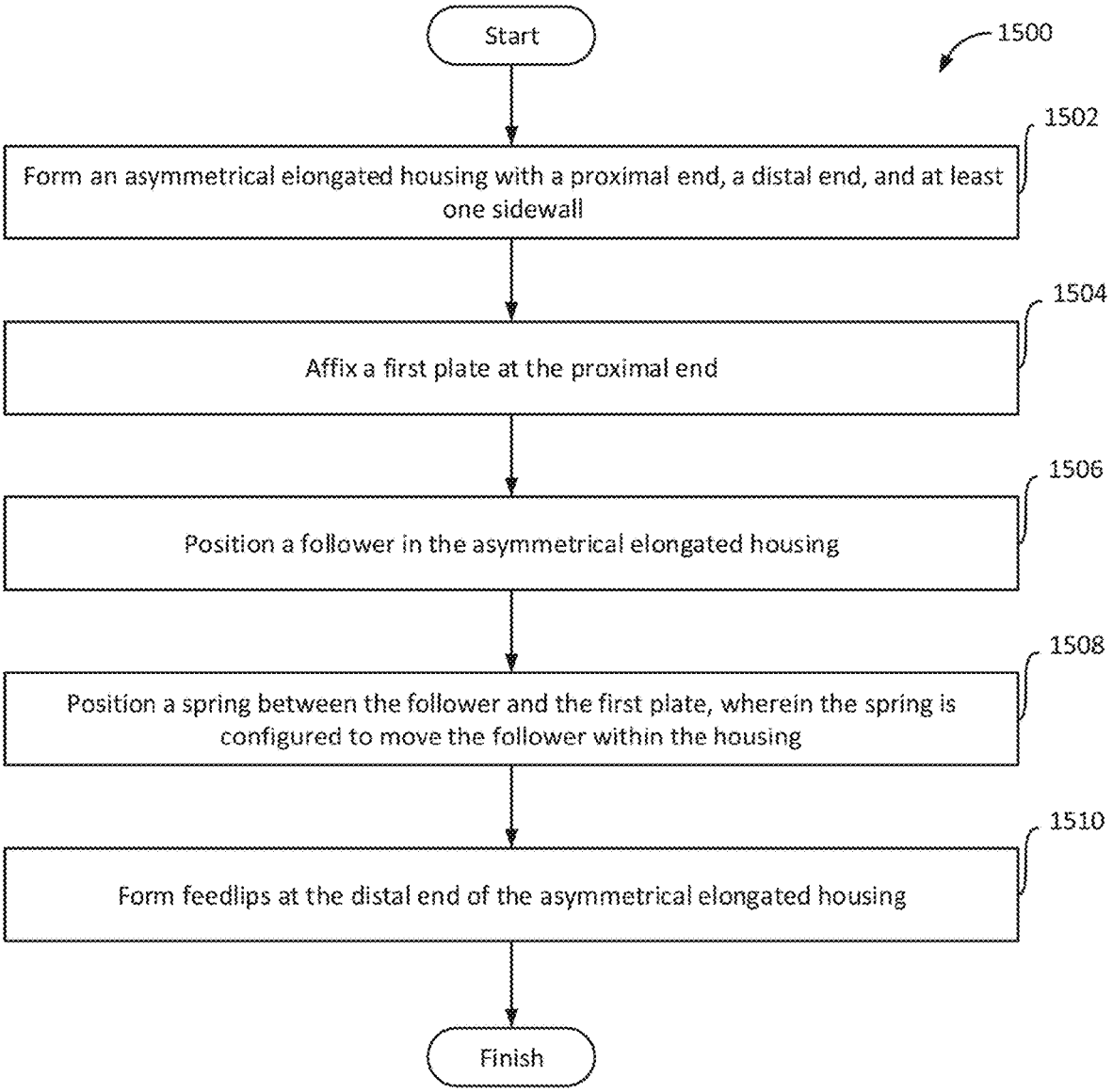
FIG. 15 illustrates a method for manufacturing a firearm magazine in accordance with one or more implementations.

FIG. 15 illustrates a method 1500 for manufacturing a firearm magazine in accordance with one or more implementations. In some examples, method 1500 may implement one or more aspects of the figures described herein. In some cases, the firearm magazine described in relation to FIG. 15 may be configured to store and feed cartridges of a first size into a firearm originally configured to fire cartridges of a second larger size. The firearm may comprise one of a bolt or a slide movable between an open and a closed position, where the bolt or the slide may be adapted to load cartridges from the magazine into a chamber of the firearm.

At 1502, the method 1500 may comprise forming an asymmetrical elongated housing with a proximal end, a distal end, and at least one sidewall. In some examples, the method 1500 may optionally comprise forming at least one tapered section between the proximal and distal end.

At 1504, the method 1500 may comprise affixing a first plate, such as a floor plate, at the proximal end. Further, at 1506, the method may comprise positioning a follower in the asymmetrical elongated housing. In some embodiments, the follower may be configured to support a plurality of cartridges.

At 1508, the method 1500 may comprise positioning a spring between the follower and the first plate, wherein the spring is configured to move or slide the follower within the housing based on a compression or decompression of the spring.

At 1510, the method 1500 may comprise forming feedlips at the distal end of the elongated housing, wherein the feed lips are adapted to hold a topmost cartridge of a plurality of cartridges within the firearm magazine until the topmost cartridge is fed into a chamber of the firearm upon action of the bolt or the slide of the firearm, and wherein one or more of the feedlips, the elongated housing, and the tapered section are shaped to force the topmost cartridge to be off-center from the bolt of the firearm so as to increase an engagement or overlap between the bolt and the topmost cartridge prior to feeding. In some cases, the topmost cartridge may be in a single stack configuration, although different cartridge configurations are contemplated in other embodiments.

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

The terms and expressions employed herein are used as terms and expressions of description and not of limitation, and there is no intention, in the use of such terms and expressions, of excluding any equivalents of the features shown and described or portions thereof. Each of the various elements disclosed herein may be achieved in a variety of manners. This disclosure should be understood to encompass each such variation, be it a variation of an embodiment of any apparatus embodiment, a method or process embodiment, or even merely a variation of any element of these. Particularly, it should be understood that the words for each element may be expressed by equivalent apparatus terms or method terms-even if only the function or result is the same. Such equivalent, broader, or even more generic terms should be considered to be encompassed in the description of each element or action. Such terms can be substituted where desired to make explicit the implicitly broad coverage to which this invention is entitled.

As but one example, it should be understood that all action may be expressed as a means for taking that action or as an element which causes that action. Similarly, each physical element disclosed should be understood to encompass a disclosure of the action which that physical element facilitates. Regarding this last aspect, by way of example only, the disclosure of a "protrusion" should be understood to encompass disclosure of the act of "protruding"—whether explicitly discussed or not—and, conversely, were there only disclosure of the act of "protruding", such a disclosure should be understood to encompass disclosure of a "protrusion". Such changes and alternative terms are to be understood to be explicitly included in the description.

What is claimed is:

1. A magazine assembly for a firearm, the magazine assembly comprising:

an elongated housing comprising a proximal portion toward a proximal end and a distal portion toward a distal end, wherein the distal portion is configured to be inserted within and to engage with a magazine well of a firearm and wherein the proximal portion is narrower than the proximal portion;

a first plane bisecting the distal portion;

a second plane bisecting the proximal portion and passing through a centerline of a topmost cartridge, wherein the first and second planes are parallel but offset from each other;

a spring positioned in an interior of the elongated housing;

at least one follower configured to move within the elongated housing based in part on a compression and decompression of the spring, and wherein the at least one follower is configured to support one or more cartridges;

one or more feedlips positioned at the distal end of the elongated housing; and wherein the centerline of the topmost cartridge is in a second plane that is parallel to and laterally offset from the first plane.

2. The magazine assembly of claim 1, wherein the first and second planes are configured to be parallel to a longitudinal axis of the firearm.

3. The magazine assembly of claim 2, wherein the distal and proximal portions are asymmetric.

4. The magazine assembly of claim 1, wherein the one or more feedlips comprise a pair of feedlips that are asymmetric with respect to the distal portion and are thereby configured to force the topmost cartridge to be offset from the bolt or slide of the firearm.

5. The magazine assembly of claim 4, wherein the pair of feedlips comprises first and second feedlips having different heights with respect to the distal end of the elongated housing.

6. The magazine assembly of claim 5, wherein at least one of a length, curvature, rigidity, or elasticity of the first feedlip is different from that of the second feedlip.

7. The magazine assembly of claim 1, wherein the magazine assembly is configured to store and feed cartridges of a first size and a second larger size.

8. The magazine assembly of claim 1, wherein a remainder of the one or more cartridges below the topmost cartridge are arranged in one of a single stack, dual stack, or staggered configuration.

9. The magazine assembly of claim 1, further comprising:

at least one mag stop configured to interact with the magazine well of the firearm, and wherein a position of the at least one mag stop between the proximal and distal ends is configured to enhance engagement or overlap between a bolt or slide of the firearm and the topmost cartridge.

10. The magazine assembly of claim 1, wherein the magazine comprises cartridges of a different size than cartridges that a receiver of the firearm is configured to operate with.

11. A firearm having a magazine well, said firearm comprising:

a stock assembly comprising one of a bolt or a slide and a receiver, wherein the receiver is configured for use with cartridges of a first size, and wherein a centerline of the bolt or slide is in a first plane;

a forend assembly;

and a magazine releasably insertable into the magazine well; wherein the magazine comprises:

an elongated housing having a distal end and a proximal end, a first plate removably engaged with the proximal end of the elongated housing, a spring, a follower, the follower configured to move within the elongated housing based in part on a compression and decompression of the spring, feedlips positioned at the distal end of the elongated housing; wherein the first plane passes through the first plate and wherein the housing is shaped and positioned such that the topmost cartridge is offset from the first plane.

12. The firearm of claim 11, wherein the magazine is configured to store and feed cartridges of a second size into the firearm, the second size different from the first size.

13. The firearm of claim 11, wherein a centerline of the magazine well coincides with the centerline of the bolt or slide, and wherein the centerline of the topmost cartridge is misaligned with respect to the centerline of the bolt or slide.

14. The firearm of claim 11, wherein the feedlips comprise a first feedlip and a second feedlip arranged on opposing sides of the elongated housing, and wherein the first and second feedlips are asymmetric with respect to the elongated housing and are shaped and positioned to force the topmost cartridge to be off-center from the bolt or slide of the firearm.

15. The firearm of claim 14, wherein at least one of a length, curvature, rigidity, or elasticity of the first feedlip is different from that of the second feedlip.

16. The firearm of claim 14, wherein the first feedlip and the second feedlip are positioned at different heights with respect to the proximal end of the elongated housing.

17. The firearm of claim 11, wherein first and second longitudinal surfaces of the topmost cartridge are at distinct distances from a respective first and second longitudinal surface of the bolt or slide.

18. The firearm of claim 11, wherein the topmost cartridge is in a single stack configuration.

19. A method for manufacturing a firearm magazine, the firearm magazine configured to store and feed cartridges of a first size into a firearm originally configured to fire cartridges of a second larger size, said firearm comprising: one of a bolt or a slide movable between an open and a closed position, the method comprising:

forming an asymmetrical elongated housing with a proximal end and a distal end;

affixing a first plate at the proximal end;

positioning a follower in the asymmetrical elongated housing;

positioning a follower spring between the follower and the first plate;

forming feedlips at the distal end of the asymmetrical elongated housing, wherein the feedlips are adapted to hold a topmost cartridge of a plurality of cartridges within the firearm magazine until the topmost cartridge is fed into a chamber of the firearm, and wherein a centerline of the bolt or slide of the firearm is in a first plane, and wherein one or more of the feedlips and the asymmetrical elongated housing are shaped such that a centerline of the topmost cartridge is offset from the first plane.

* * * * *